US006257294B1

(12) United States Patent
Weisbeck

(10) Patent No.: US 6,257,294 B1
(45) Date of Patent: Jul. 10, 2001

(54) HIGH SPEED PRODUCE LABEL APPLICATOR

(75) Inventor: Richard Wayne Joseph Weisbeck, Kelowna (CA)

(73) Assignee: Agri-tech, Ltd., Woodstock, VA (US)

( * ) Notice: Subject to any disclaimer, the term of this patent is extended or adjusted under 35 U.S.C. 154(b) by 0 days.

(21) Appl. No.: 09/252,829

(22) Filed: Feb. 19, 1999

Related U.S. Application Data

(60) Provisional application No. 60/077,441, filed on Mar. 10, 1998.

(51) Int. Cl.[7] ..... B65C 9/42; B65C 9/14

(52) U.S. Cl. ..... 156/356; 156/361; 156/387; 156/566; 156/567

(58) Field of Search ..... 156/356, 361, 156/378, 385, 387, 384, 567, DIG. 44, DIG. 45, DIG. 46, 566, 556

(56) References Cited

U.S. PATENT DOCUMENTS

| | | | |
|---|---|---|---|
| 2,848,228 | 8/1958 | Kimbro | 271/26 |
| 3,616,050 | 10/1971 | Schrotz | 156/358 |
| 3,888,725 | 6/1975 | French | 156/556 |
| 4,129,473 | 12/1978 | Perret | 156/364 |
| 4,174,057 | 11/1979 | Emery | 222/332 |
| 4,189,337 | 2/1980 | Higgins et al. | 156/351 |
| 4,194,941 | 3/1980 | Briggs et al. | 156/361 |
| 4,235,661 | 11/1980 | Evrard | 156/542 |
| 4,244,763 | 1/1981 | Varon et al. | 156/74 |
| 4,293,365 | 10/1981 | Geyser et al. | 156/364 |
| 4,328,063 | 5/1982 | Ingalls | 156/361 |
| 4,512,842 | 4/1985 | Schneider | 156/357 |
| 4,526,648 | 7/1985 | Tochtermann | 156/497 |
| 4,547,001 | 10/1985 | Stitt | 283/81 |
| 4,595,447 | 6/1986 | Lindstrom | 156/364 |
| 4,707,211 | 11/1987 | Shibata | 156/354 |
| 4,784,714 | 11/1988 | Shibata | 156/354 |
| 4,881,934 | 11/1989 | Harston et al. | 493/315 |
| 4,919,747 | 4/1990 | Eagle | 156/497 |
| 4,978,416 | 12/1990 | Potter et al. | 156/571 |
| 5,054,761 | 10/1991 | Dietrich et al. | 271/95 |
| 5,104,306 | 4/1992 | Gordon et al. | 425/503 |
| 5,149,392 * | 9/1992 | Plaesemann | 156/542 |
| 5,387,302 | 2/1995 | Bernard et al. | 156/352 |
| 5,441,586 | 8/1995 | Fukunaga et al. | 156/387 |
| 5,489,360 | 2/1996 | Shimizu et al. | 156/542 |
| 5,645,680 | 7/1997 | Rietheimer | 156/567 |
| 5,660,676 | 8/1997 | Brooks | 156/361 |
| 5,829,351 | 11/1998 | Anderson et al. | 101/36 |
| 5,849,142 | 12/1998 | Fuehrer et al. | 156/556 |
| 5,888,343 * | 3/1999 | Olson | 156/556 |
| 6,024,830 * | 2/2000 | Nedblake et al. | 156/353 |

FOREIGN PATENT DOCUMENTS

| | | |
|---|---|---|
| 1 884 257 | 12/1963 | (DE) . |
| 0 113 256 | 7/1984 | (EP) . |
| 2 657 327 | 7/1991 | (FR) . |
| 96/39331 | 12/1996 | (WO) . |

* cited by examiner

*Primary Examiner*—Richard Crispino
*Assistant Examiner*—Sue A. Purvis
(74) *Attorney, Agent, or Firm*—Foley & Lardner

(57) ABSTRACT

A labeler for objects, such as fruit or vegetables, has a pickup head that includes a firing piston, and a larger piston that is coupled to the firing piston. The pickup head, along with other pickup heads, are provided on an assembly that rotates the heads in a circular manner. When each pickup head is at the 6 o'clock position, a burst of air pressure is provided to the firing piston, thereby causing it to fire and to cause the larger piston to move in an outward direction. This causes the pickup head to extend fully, to thereby cause a label positioned on an applicator at a distal end of the pickup head to contact an object and thereby apply the label to the object. At other positions besides the 6 o'clock position, a vacuum source provides a vacuum to the pickup heads, thereby maintaining the pickup heads in a fully retracted position, as well as providing a way for keeping the label on the applicator of the pickup head while the pickup head is rotating.

9 Claims, 14 Drawing Sheets

HIGH SPEED PRODUCE LABEL APPLICATOR

This Application is based on Provisional Application Ser. No. 60/077,441, filed on Mar. 10, 1998.

BACKGROUND OF THE INVENTION

1. Field of the Invention

The present invention relates to a method and apparatus for printing adhesive labels with information specific to the produce item to be labeled and applying the labels to that produce item by a vacuum/air burst system.

2. Description of the Related Art

A variety of labelling and object sorting apparatus and methods have been disclosed. The following documents are hereby incorporated by reference:

1. Patent application, entitled "Object Sorter and Sizer," applicant Roger Blood, filed on Feb. 20, 1998, patent application Ser. No. 09/027,489.
2. U.S. Pat. No. 4,194,941.
3. U.S. Pat. No. 4,189,337
4. U.S. Pat. No. 5,441,586
5. U.S. Pat. No. 5,489,360
6. U.S. Pat. No. 5,645,680
7. U.S. Pat. No. 5,387,302
8. U.S. Pat. No. 4,328,063
9. U.S. Pat. No. 4,547,001
10. U.S. Pat. No. 5,660,676
11. U.S. Pat. No. 4,174,057
12. U.S. Pat. No. 2,848,228
13. U.S. Pat. No. 3,888,725
14. U.S. Pat. No. 4,526,648
15. U.S. Pat. No. 4,707,211
16. U.S. Pat. No. 4,784,714
17. U.S. Pat. No. 4,919,747
18. U.S. Pat. No. 4,978,416
19. European Patent Application No. EP 0 113 256 A2

Generally, in a conventional produce labeller, pre-printed labels are used requiring one to order in advance labels for different varieties of produce, such as fruits and vegetables. There are as many as 60 or 70 varieties of some fruits. The labels usually are printed before the produce season begins each year. Quantities of labels to be printed are based on a rough estimate of the type of produce that would be available in that given year. However, the necessary quantities of pre-printed labels for each variety of produce are difficult to predict. Thus, for example, on must guess how many large red delicious apple labels or how many small red delicious apple labels would be needed. Conventional produce labellers require ordering and buying these pre-printed labels whether or not they are eventually used. One must also estimate minimum quantities of pre-printed labels which might be required. Often these estimates are inaccurate resulting in a waste of the labels. Further label waste results from the practice of ordering more labels than the anticipated requirement in order to avoid label shortages if additional fruit requires packing.

SUMMARY OF THE INVENTION

The present invention is a label applicator, which includes a label carrier reel containing a plurality of unprinted labels. The label applicator also includes a print station including a printer, positioned to print a desired image on said unprinted labels to provide printed labels. The label applicator further includes a pickup head for picking up the printed labels from said print station at a label transfer position, rotationally carrying said printed labels from said label transfer position to a label deposit position, and successively placing the printed labels on individual objects.

According to the invention, blank labels on a backing tape are supplied to a printer. Even before the printer completes printing information on a blank label, a pickup head at a label transfer position begins to remove the label from the backing tape. A vacuum is applied through the pickup head to remove and hold the printed label onto an applicator at the end of the pickup head. The pickup head, which is mounted on a rotating plate, remains in a retracted position until it rotates from the label transfer position to a label deposit position. At the label deposit position, pressure, such as air pressure is applied to drive a firing piston to apply force to a main piston. Momentum of the main piston drives the applicator with the label toward the object to be labelled. After the pickup head rotates away from the label deposit position, the vacuum retracts the pickup head and applicator.

The system can be controlled to prevent the pickup head from advancing at the label deposit position, for example when no object is present. Alternatively, the labelling apparatus construction can be simplified by allowing the pickup head to advance each time it passes the label deposit position. In order to avoid wasting labels, using the same control system that informs the printer what information to print, the printer can also advise the printer when no object requiring a label is present. The printer will then cease printing and advancing the label tape until another label is needed. As a result, the labelling apparatus can have a conveniently simplified mechanical construction in which the pickup head always advances at the label deposit position, because it does not have a label on the applicator where no label is required but does have a label on the applicator when an object requires labelling.

BRIEF DESCRIPTION OF THE DRAWINGS

The invention will become more fully apparent form the following detailed description when read in conjunction with the accompanying drawings, with like reference numerals indicating corresponding parts throughout, and wherein.

DETAILED DESCRIPTION OF THE PREFERRED EMBODIMENTS

The present invention provides an apparatus in which the labels are not pre-printed but rather are printed and then applied to the produce in real time.

FIGS. 1–6B illustrate the high speed produce labeller according to a first embodiment of the present invention. The third embodiment, to be described later, utilizes all of the features shown in the first embodiment, but with a differently configured pickup head.

Figure 1:
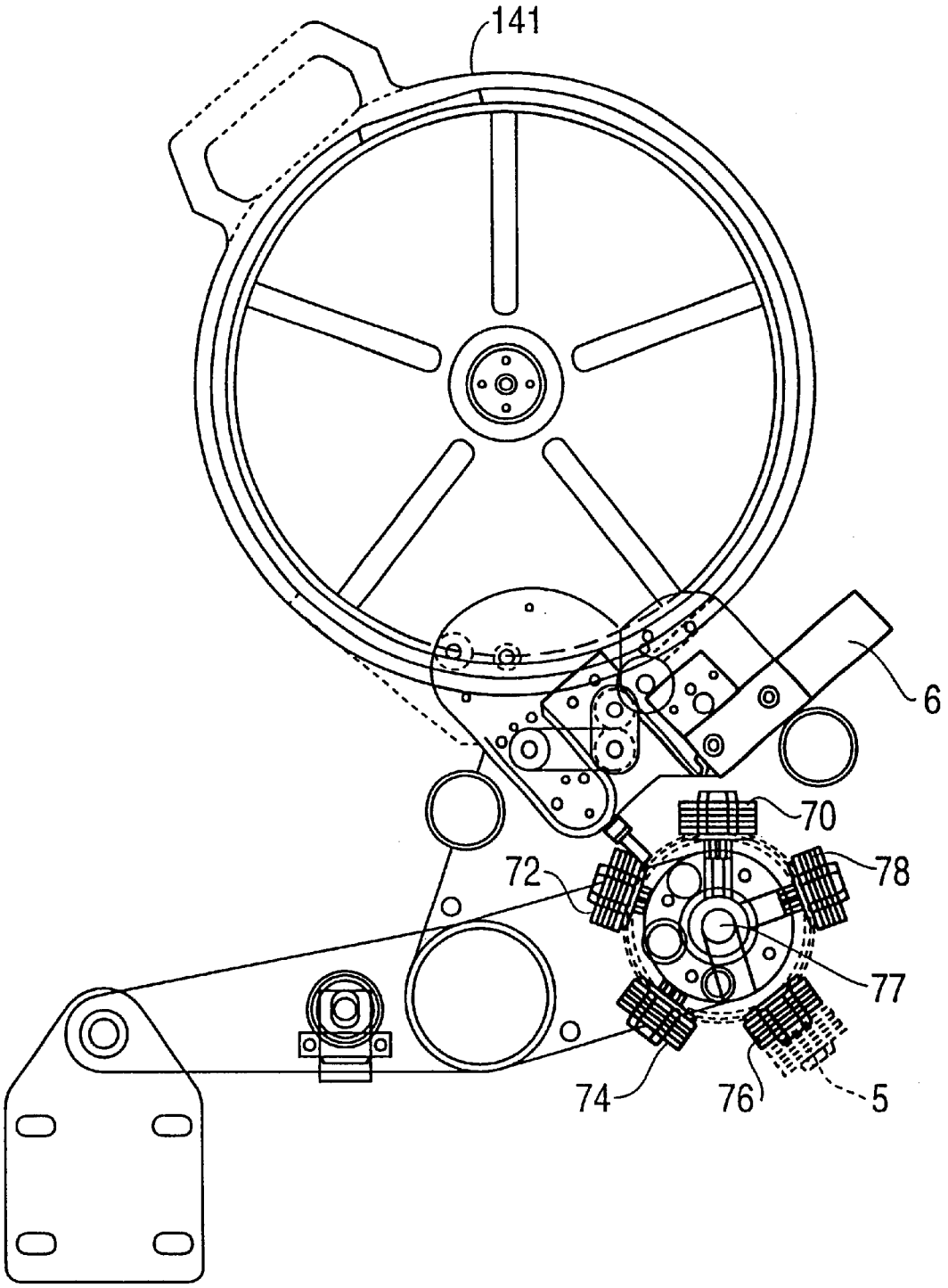
FIG. 1 shows a label applicator according to a first embodiment of the invention.
Figure 2:
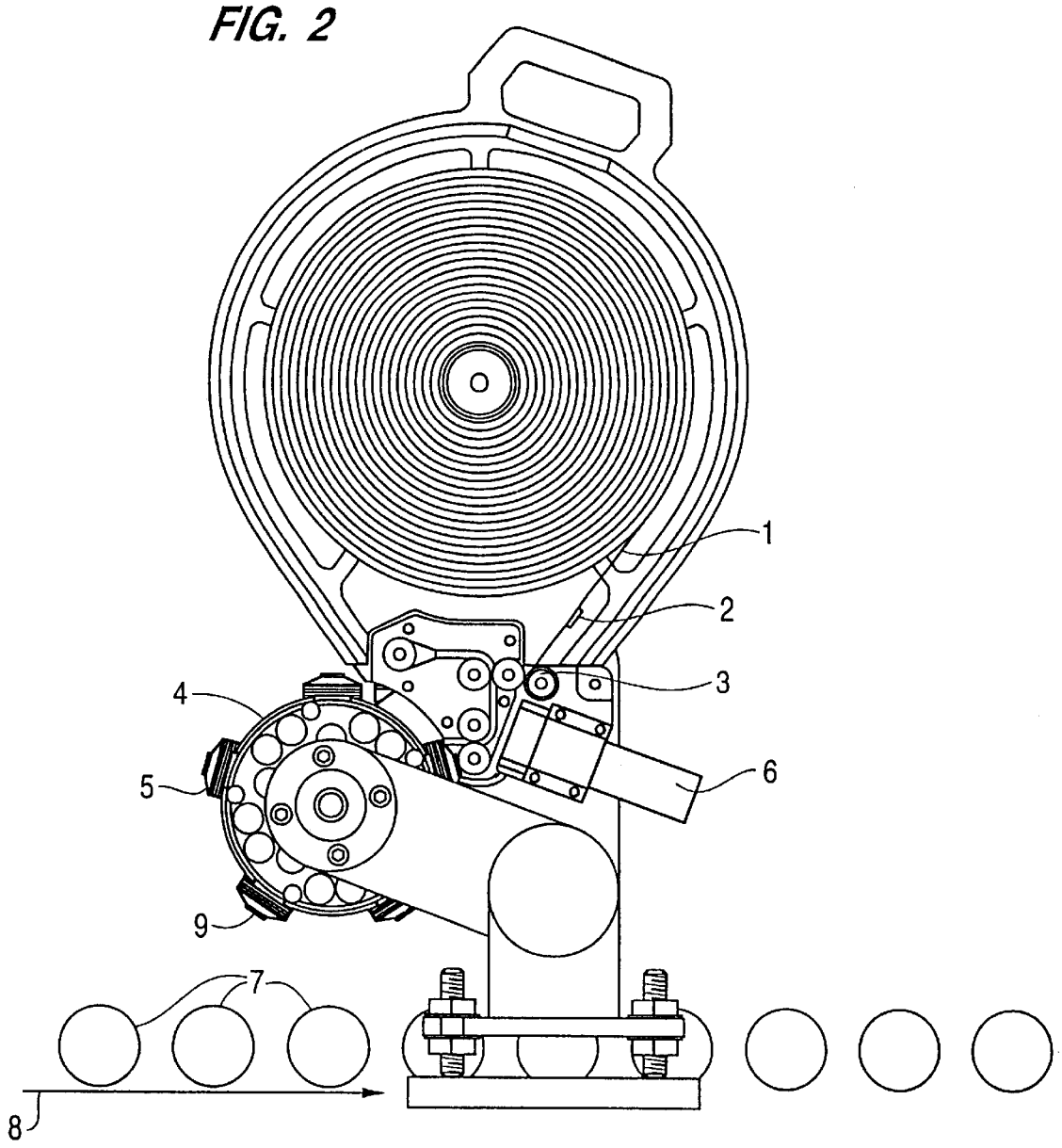
FIG. 2 shows a label applicator and a conveyor providing objects to be labeled, according to the first embodiment of the invention.

As shown in FIGS. 1 and 2, a silicone-coated backer tape (1) to which the labels (2) are affixed is fed from a feed roller (3) to an applicator head (4) having one or more pickup heads (5). The applicator head (4) is shown as a rotary applicator head. Those of ordinary skill will recognize that other applicator head configurations, such as a reciprocating applicator head which moves back and forth, could also be used. Five pickup heads (5) are shown pivoting around point 77 in FIGS. 1 and 2, although any number of such pickup heads may be used. A printer (6), for example, an ink jet printer, is located between the feed roller (3) and the applicator head (4). As each label (2) on the backer tape (1) approaches one of the pickup heads (5), it comes off the tape (1) and held on the pickup head (5) by suction. Once the pickup head (5) has rotated to a label deposit position, for example, approximately the six o'clock position, a vigorous burst of positive air pressure is applied to that pickup head. The label (2) is projected off the pickup head (5) through the air, adhesive side down, onto an item of produce (7) or other object passing by means of a conveyor (8) beneath the apparatus.

Figure 12:
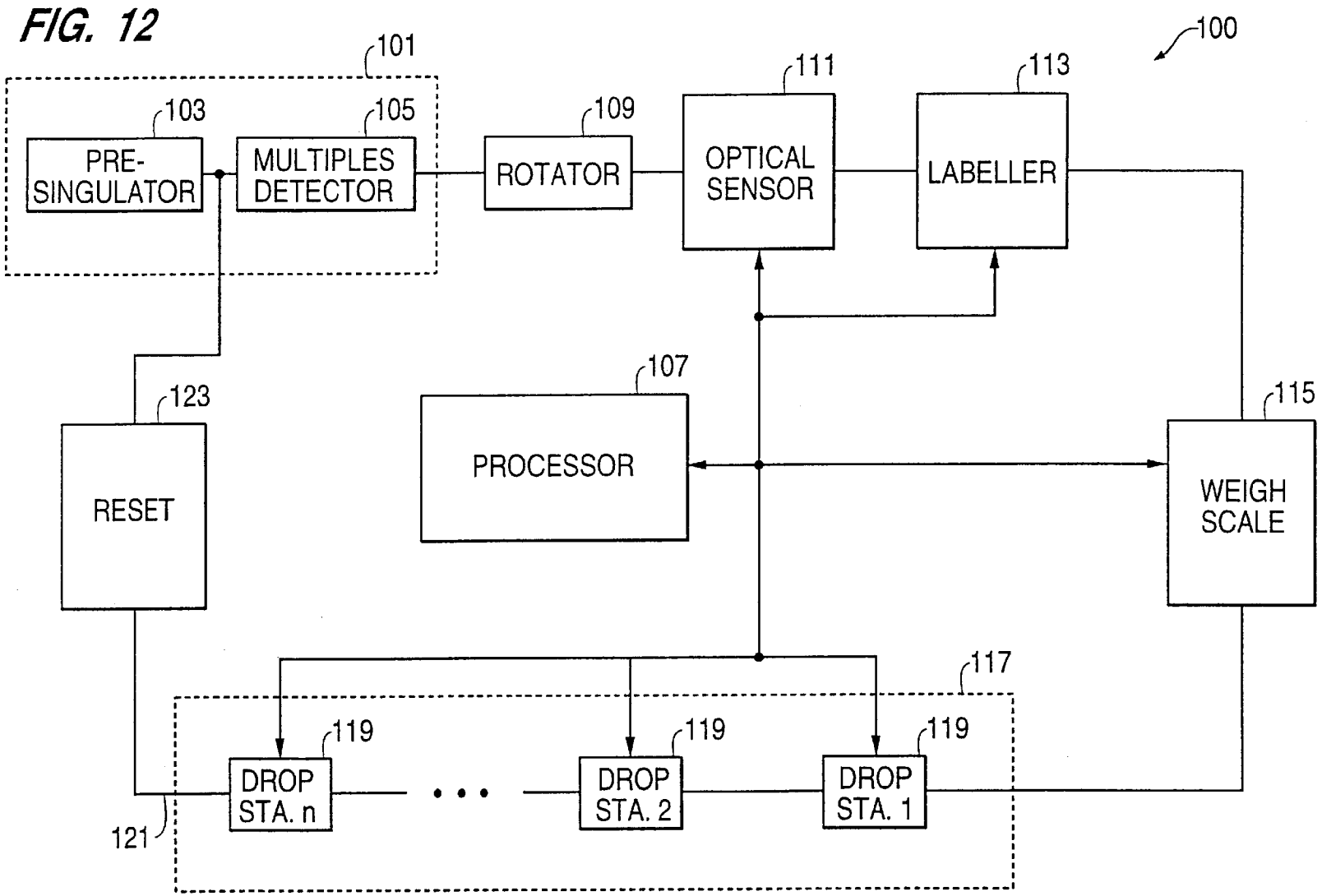
FIG. 12 shows in block diagram form elements making up a label applicator according to the invention.

An encoder coordinates the movement of the feed roller and the applicator head. The conveyor (8) is typically a series of transversely disposed rollers or alternatively has evenly spaced cups for receiving each produce item (7) and locating it in a predetermined position as it passes beneath the applicator head (4). Prior to passing beneath the applicator head (4), each produce item (7) passes a classifier which senses its presence on the conveyor and also senses one or more classifying parameters, such as weight and color content of the item, and classifies it accordingly. As discussed further herein, FIG. 12 illustrates such a system. The information pertaining to the sensed classification is transmitted to the printer (6) via a computer or other processor. A label (2) is printed with information that corresponds to the classification of the item and the label (2) is applied to the object (7).

Referring to FIG. 2, the labels are sticky backed and mounted on a continuous, silicone coated backer. The tape roll (1) is fed by a series of synchronized feed rollers (3) and passes by a print head of the printer (6). The label (2) is printed with ink while it is moving through the turn bar assembly (10). The labels (2) are fed in a "start/stop" motion, and are plucked from the tape backer (10) by one of the pickup heads (5). The label (2) is held by suction through a grid of small holes (9) in the distal portion of the pick-up head (5). The rotary applicator head (4) rotates and when it is positioned over the produce item, the pick-up head (5) projects the label (2), sticky side down, onto the produce item (7).

In the first embodiment, the labels themselves are projected to object to be labeled without the pickup head (5) contacting the object. Alternatively, in a second embodiment, a bellows type applicator can be utilized, instead of the projecting pickup head (5). In this case the pickup head (5) carrying the label projects toward the object to be labelled and makes contact with the object to deposit the label. As discussed further herein in a third embodiment the pickup head (5) can be constructed with a piston arrangement. The remaining features disclosed herein can be used with any pickup head arrangement, including those disclosed herein.

Figure 3:
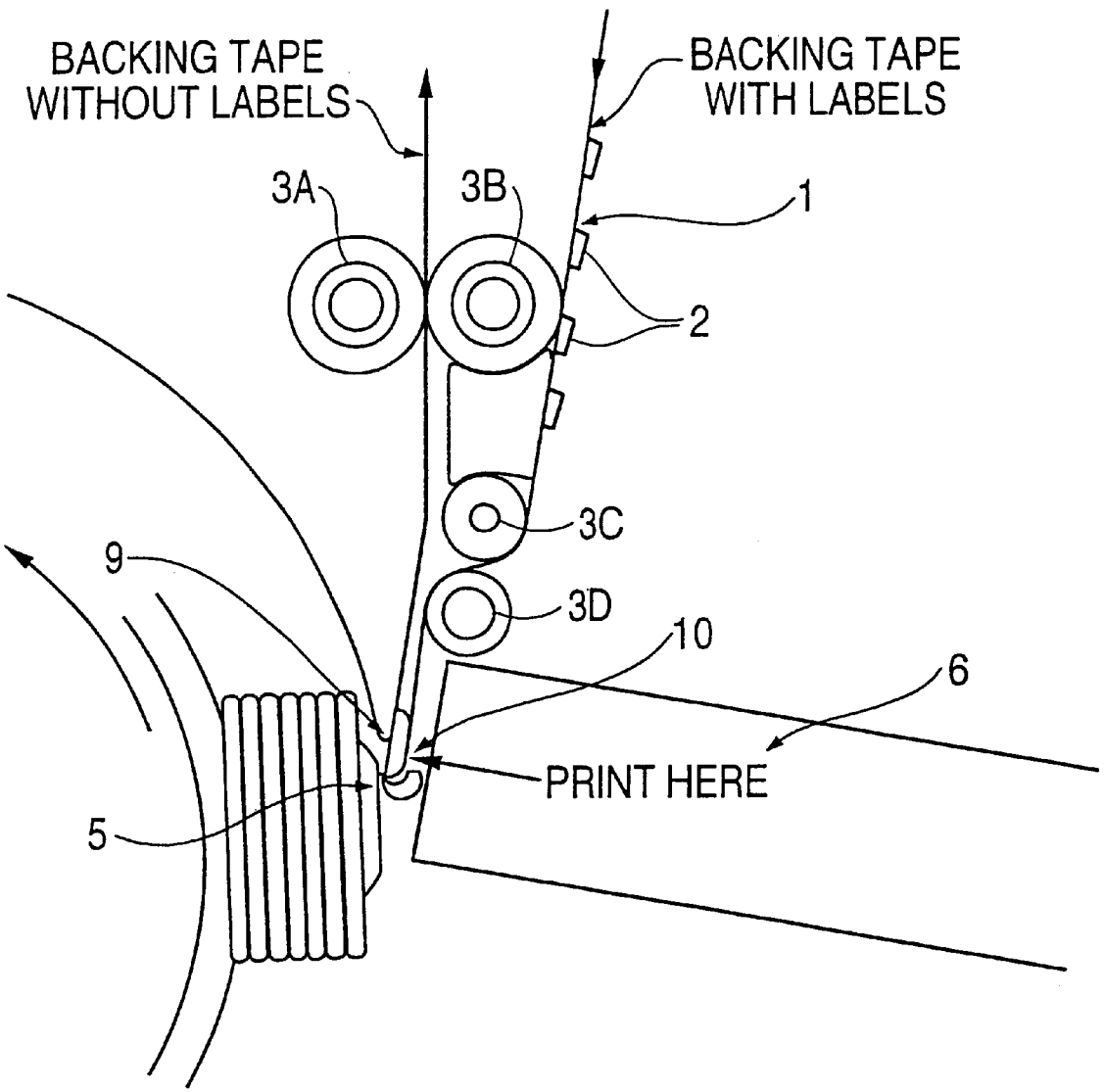
FIG. 3 shows details of a label according to the invention.

Referring to FIG. 3, the circular, elliptical, or other shaped paper label (2) is held to a siliconized backer tape (1) by an adhesive to form a continuous length of tape and is provided in roll form.

Figure 4:
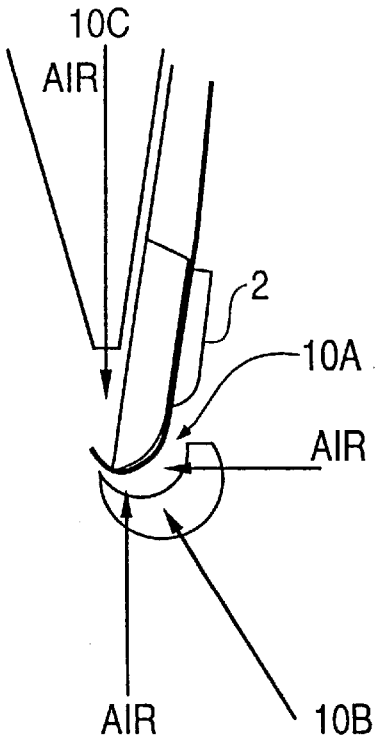
FIG. 4 shows details of air provided during a label printing according to the invention.

FIG. 3 shows that the backer tape (1) with labels (2) is fed in a first direction toward printer (6), through a series of rollers (3A)–(3D), to deliver the label to the turn bar assembly (10). During the feed, the label (2) is printed by the ink jet printer (6). Referring also to FIG. 4, as shown at (10A) while rotating around the turnbar (10), the label (2) is first held to the curvature of the turnbar by the airstream at (10B). The label (2) is then peeled off the backer tape as it moves about the turnbar with the assistance of another airstream at (10C), that lifts the label from its backer tape (10) to apply it to the pickup head (5). The pickup head (5) applies suction to draw label (2) toward the distal end of the pickup head (5). At this point, the linear speeds of the label and the rotating pickup head (5) are the same. The transfer is made as the label is provided on to the pickup head (5).

While the label would have a tendency to delaminate at the first turn of the turn bar (10A), it is held to the backing tape and the shape of the turn bar (10) by way of the force of air streams discussed above, which are supplied by strategically placed air jets. These air jets force the label to turn with the backing. In one possible configuration, as seen in FIG. 4, a first air jet 10A directs air from a 3 o'clock position, a second air jet 10B directs air from a 6 o'clock position, and a third air jet 10C directs air from an 11 o'clock position. These air streams are used to turn the label and force dry the ink applied simultaneously to the label. The drying function allows the labels to be printed and applied at a high speed rate. The print and apply rate, for example, is 10/sec. Airstream (10A) turns the label on a cushion of air (10B), and it also provides a forced drying of the printed ink. Airstream (10C) pushes the label to pickup head (5), as best seen in FIG. 3.

Air streams are produced by a number of jets. In another configuration, each air stream is produced by 3 jets, one set of jets being approximately spaced so as to provide air directed perpendicular to the label at the 3 o'clock position and another 3 jets similarly spaced and directed toward the tape at the 6 o'clock position, (90 degrees apart). This configuration is shown in FIG. 4. The air source can be precisely controlled by pressure and flow regulation. The air pressure output by these air jets are preferably in the 10–20 psi range, and low air pressure is all that is needed to dry the ink and to push the labels in the proper direction.

Figure 5:
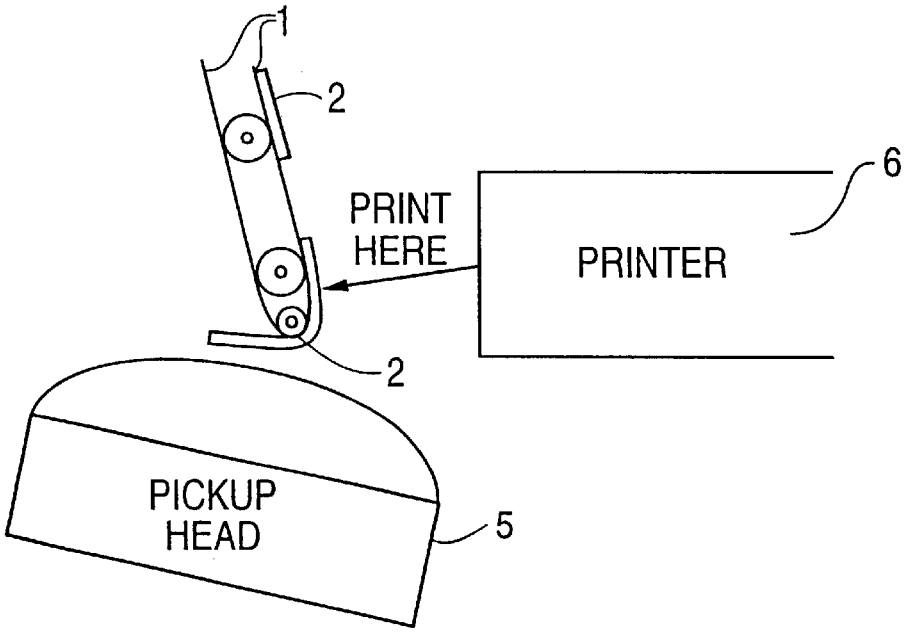
FIG. 5 shows details of a label applied to a pickup head during a printing operation, according to the invention.
Figure 6A:
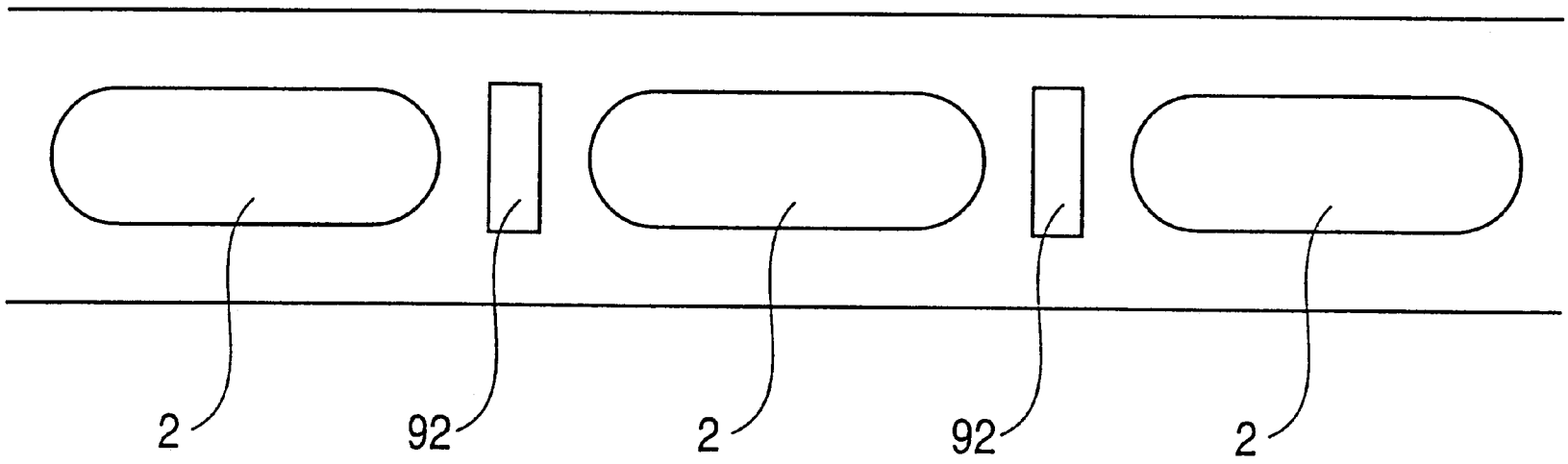
FIG. 6A shows a backer tape that holds labels, according to the invention.
Figure 6B:
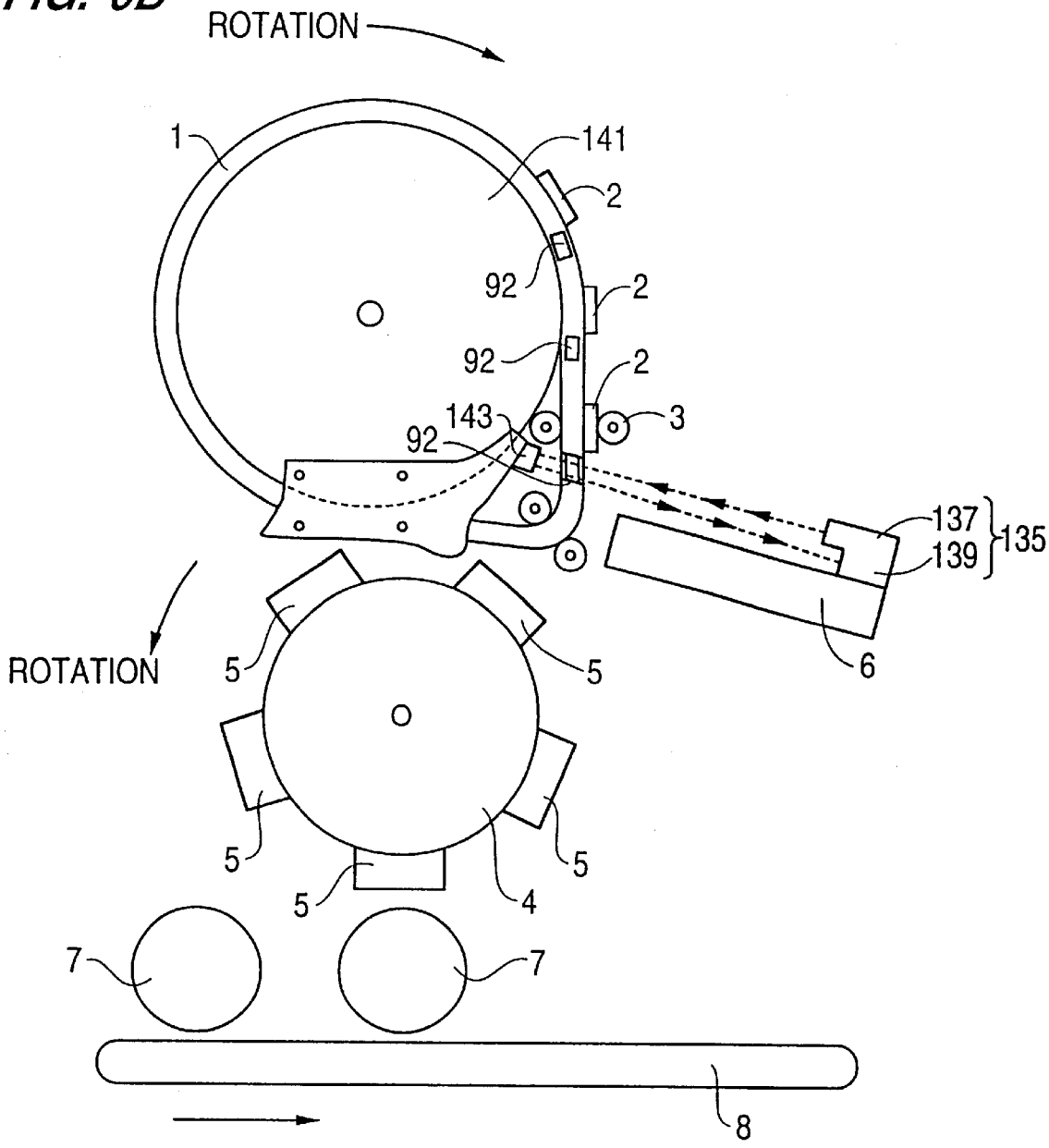
FIG. 6B shows features of backup tape advance synchronizing, according to the invention.

Referring now to FIG. 5, the print and apply operation is a real time operation that occurs "just in time", i.e., the label is printed and applied at roughly the same time. As shown in FIG. 5, the pickup head (5) makes contact with the label (2) before it is completely printed by printer (6). Alternatively, the label (2) can be completely printed before making contact with pickup head (5).

The apparatus is also equipped with a sensor (135) which detects position encoder markings on the side of the backer tape facing the printer (6). As shown in detail in FIGS. 6A and 6B, the backer tape preferably has a small key punch slot (92) between each of the labels (2). A transmitted portion (137) of the sensor (135) transmits an optical signal which, when registered with the key punch slot, is reflected back to a collector portion (139) of the sensor (135). The reflector could be a reflective object (143) located behind the backer tape. Alternatively key punch slot (92) could be replaced by a reflective portion on the backer tape itself, eliminating the need for reflective object (143). The sensor (135) thus provides essential information concerning the precise position of the label (2) as it passes the printer (6) and proceeds to the applicator head (4). The use of a reflector rather than an optical receiver allows the entire sensor to be located facing on the side of the backer tape to be printed. This facilitates replacement of the feeder roll (141) and does not make it necessary for having such electrical connections, since it is not necessary to align optical receiver on the feeder roll with an optical signal transmitter.

Referring back to FIGS. 1 and 2, the speed of the circumference of the label wheel on which the backer tape (1) mounts is coordinated with the linear speed of the conveyor (8). In the example, the pickup heads (5) rotate in a counterclockwise direction. Location (70) of the pickup head (5) is the location at which the label is printed. After label printing, pickup head (5) rotates counterclockwise, moving through the positions (72), (74) and (76). The label is applied to the produce, fruit or other object (7) at the 6 o'clock position (see FIG. 2). The pickup head (5) follows the object (7) to make sure that the label (2) is applied firmly onto the surface of the object. Since the printing is done while the backer tape is moving, the printer must take into consideration the acceleration of the backer tape, and adjust the printing to provide a uniform printing on the label.

The label (2) is pulled off the backer tape as previously discussed at the 12 o'clock position. A vacuum or suction applied through holes (9) in the distal end of pickup head (5) holds the label (2) with the sticky side up to the label head and it maintains the suction position until it rotates all the way to location (76). Label printing occurs at the 12 o'clock position. The labels are on the reel and then pulled off at this location. The printing and pulling off occurs at virtually the same time. Printing occurs on one side of the label. The vacuum holds the label onto the pickup heads. As the label rotates to the 6 o'clock position, the sticky side faces down, and is placed on the object (7).

Figure 7:
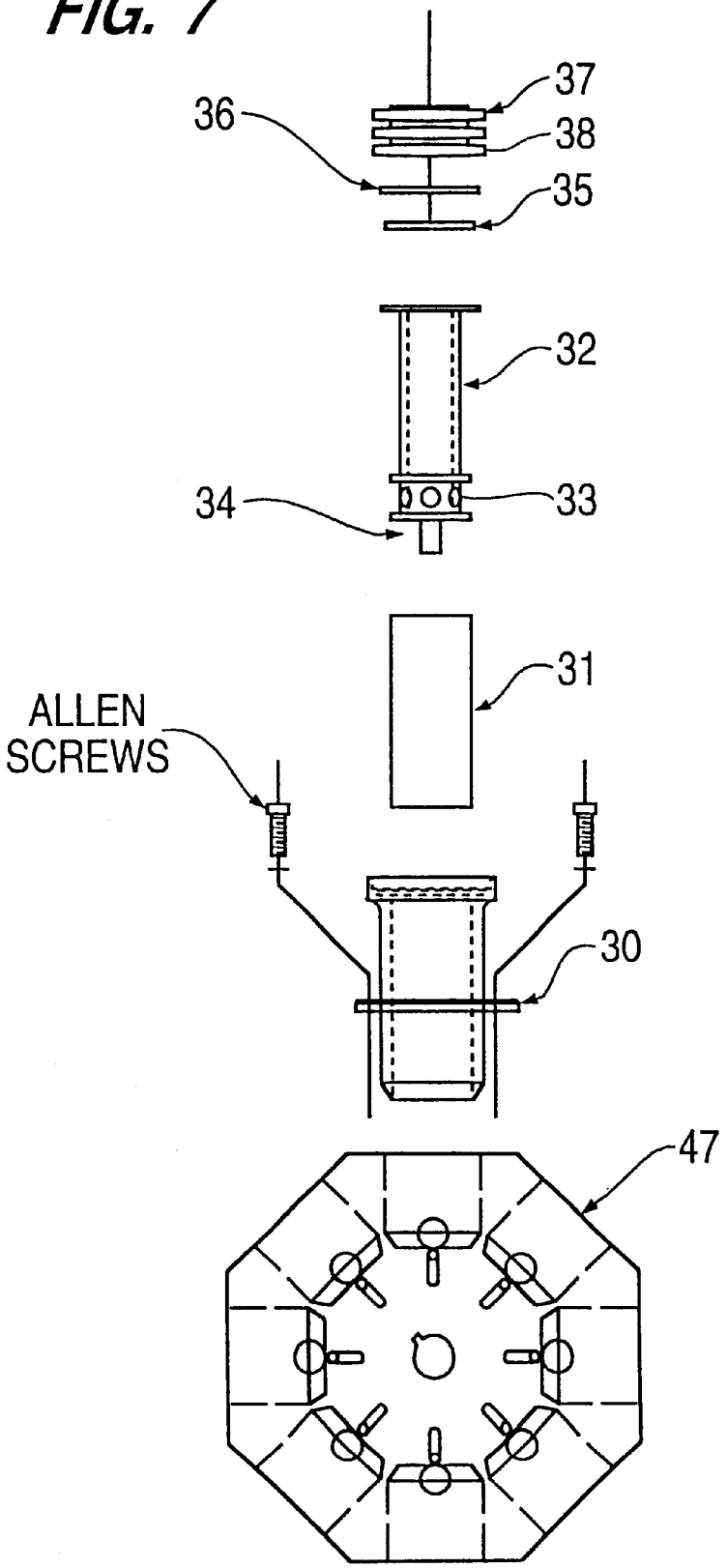
FIG. 7 shows details of a pickup head according to a third embodiment of the invention.

FIG. 7 illustrates a pickup head assembly that may be utilized according to a third embodiment of the invention. The pickup head has a cylinder body (30), typically made of aluminum, cylinder (30) may be equipped with a liner (31) therein, such as a brass liner. Main piston (32), made for example of Delrin, fits within the cylinder or cylinder liner. Main piston (32) has vacuum ports (33) built into it which connect to a hollow interior portion of the main piston. At the lower portion of main piston (32) is a smaller firing piston (34). Main piston (32) is connected to a stop (35), for example of molybdenum-filled nylon, which restricts its motion. A retaining ring (36) and an applicator (37) are located at the distal end of the pickup head (5A).

Applicator (37) is formed of a material such as silicon rubber or the like, and has a one or more holes (9A) located at a top portion thereof (that portion on which the label is placed) to supply the suction to hold the label (2) on the pickup head (5A) as it is transported before being deposited on the object (7).

As discussed further herein, holes (9A) in applicator (37) hold the label (2) on the pickup head (5A) as a result of the vacuum applied through the vacuum ports (33). This vacuum also retracts the pickup head (5A) from its extended position after the label (2) is deposited on the object (7). Also as further discussed herein, the firing piston (34) is triggered by a burst of air or other pressure source to initiate outward movement of the main piston (32). As a result of its momentum, main piston (32) continues its outward motion to allow applicator (37) on the distal end to deposit a label (2) on object (7). The applicator (37), as shown in FIG. 7, can be formed with one or more sculptings (38) which allow it to tilt and move in directions other than the direction of outward movement of the main piston (32). This allows the applicator (37) to effectively apply labels to objects which are not flat. Alternatively, applicator (37) can be formed using a foam material or other material that does not damage the object being labelled.

Figure 8A:
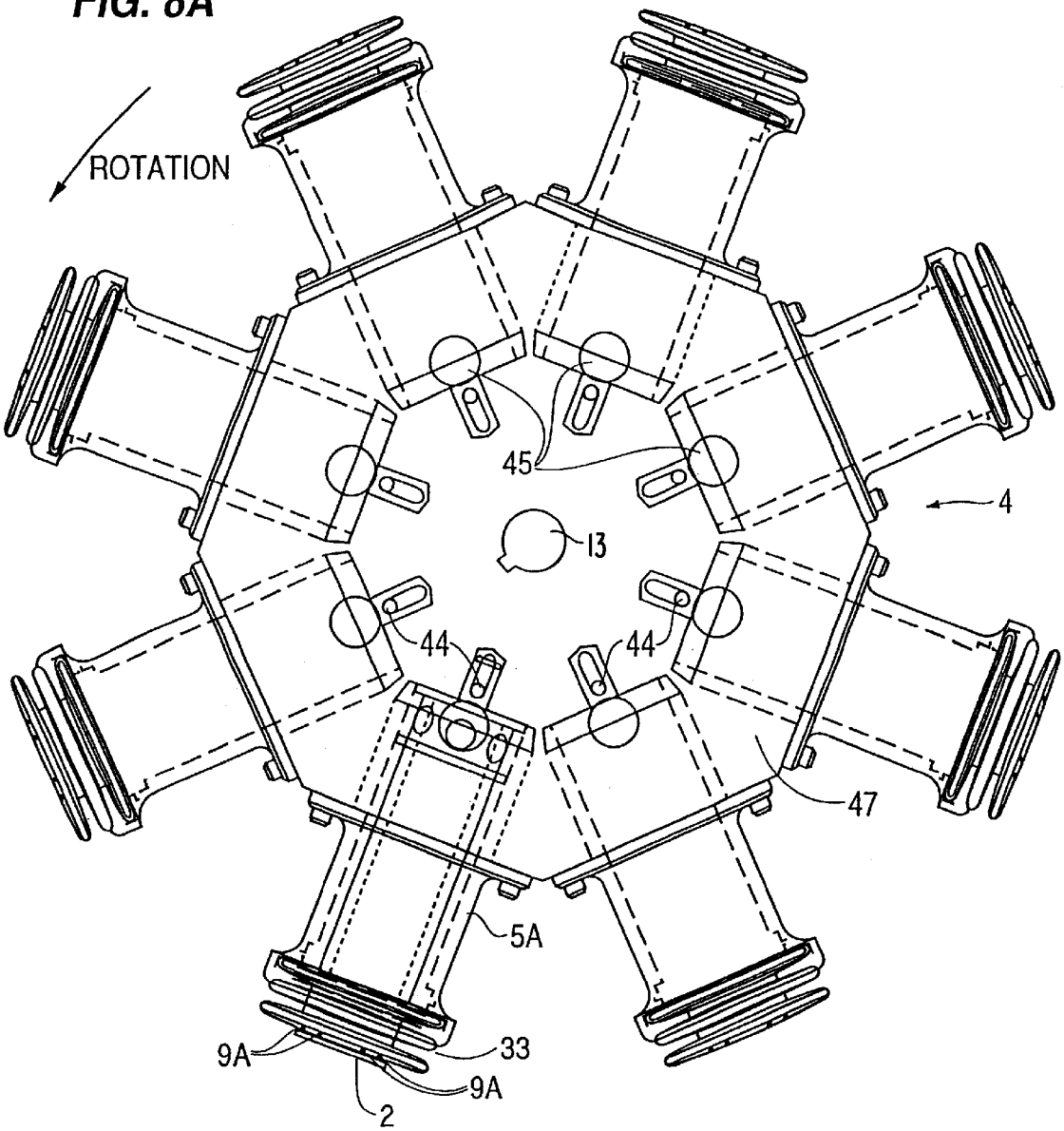
FIG. 8A shows a label held by vacuum onto a pickup head according to the third embodiment of the invention.
Figure 8B:
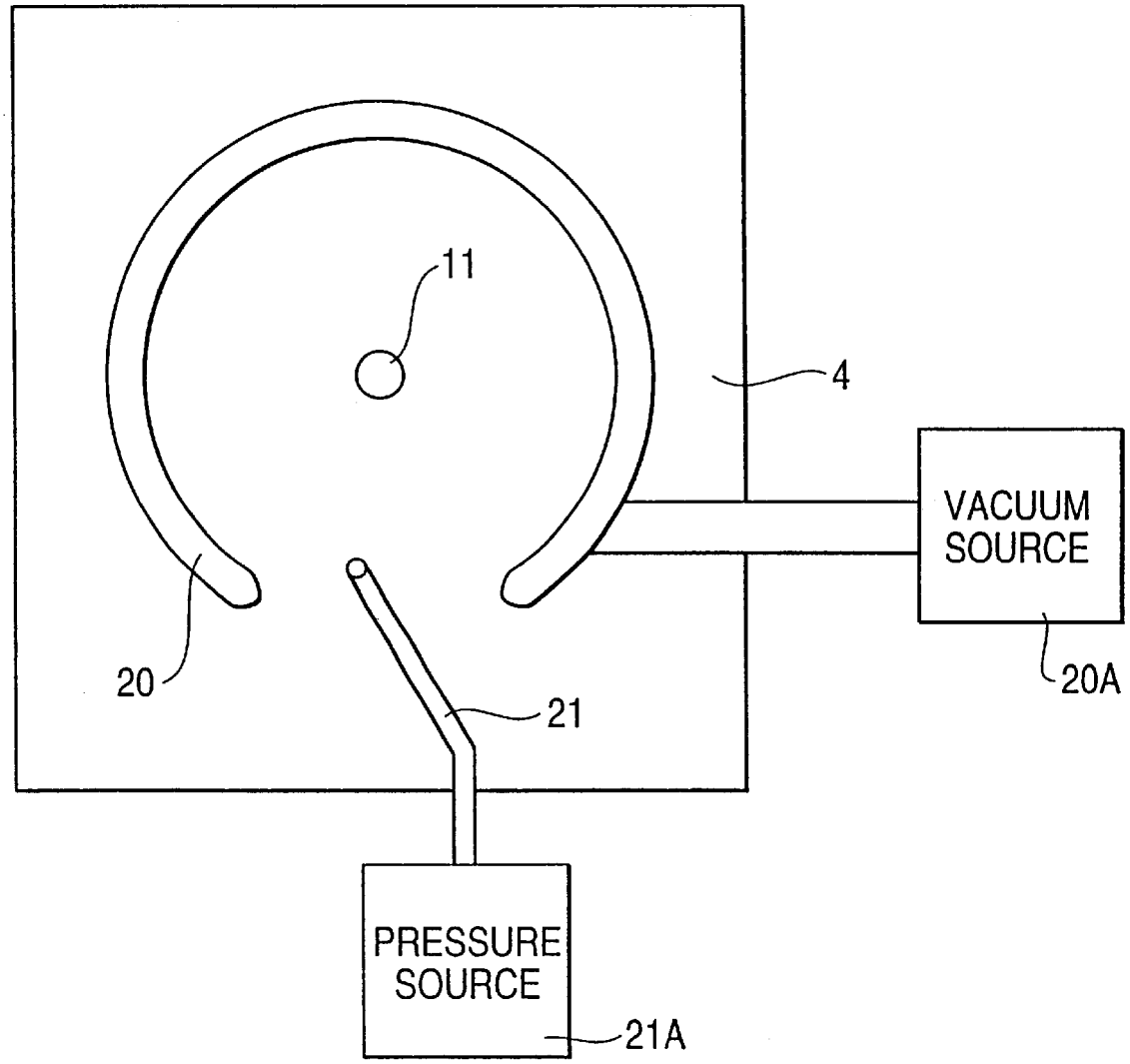
FIG. 8B shows air pressure supply elements and a vacuum supply elements according to the third embodiment of the invention.

FIG. 8A generally illustrates a rotary applicator head (4) with eight pickup heads (5A) according to the third embodiment of the invention. The rotary applicator head (4) can be formed to accommodate any desired number of pickup heads. FIG. 8A also shows a label (2) held in place on pickup head (5A) by vacuum provided to the label (2) by way of holes (9A) at the distal end of pickup head (5A), FIG. 8B shows an outer housing of the rotary applicator head (4), which has a pressure supply (21) to supply a vacuum to each of the pickup heads (5A) when they are in the 6 o'clock position, and which also has a vacuum opening (20) to supply a vacuum to the pick-up heads at other positions. As discussed further herein, the vacuum ports (33) in the pickup head use the vacuum supplied through vacuum opening (20) from vacuum source (20A) to allow the pickup head (5A) to suction the label (2) through holes (9A) and hold it on the distal end of pickup head (5A) as the label peels off the backer tape (1). FIG. 8A shows a label (2) held, by vacuum, to the applicator (33) of pickup head (5A) through holes (9A).

As shown in FIG. 8B, the vacuum supply is provided to the pickup heads by way of opening (20) on the applicator head (4). By way of illustration and not limitation, opening (20) is shown extending from about the 5 o'clock position to about the 7 o'clock position. The exact locations of the start and end positions of the opening (20) can vary. The requirement is only that the vacuum be supplied to the pickup heads (5A) continuously until just prior to application of a label onto an object, (e.g., the 7 o'clock position). The vacuum is removed and not provided again until just after the label has been applied (e.g., the 5 o'clock position). Alternatively, the vacuum may be supplied at all times except the label deposit position (e.g., 6 o'clock position). In yet another alternative, the vacuum may be supplied at all times, including the label deposit position if the air pressure supplied by pressure source (21A) through pressure line (21) overcomes the vacuum supplied by the opening (20) when the pickup head is at the label deposit position. The vacuum is supplied to the pickup heads (5A) by way of vacuum ports (45), which are positioned on the body (47) so as to allow the vacuum from the opening (20) to be received by the pickup heads (5A).

Figure 10:
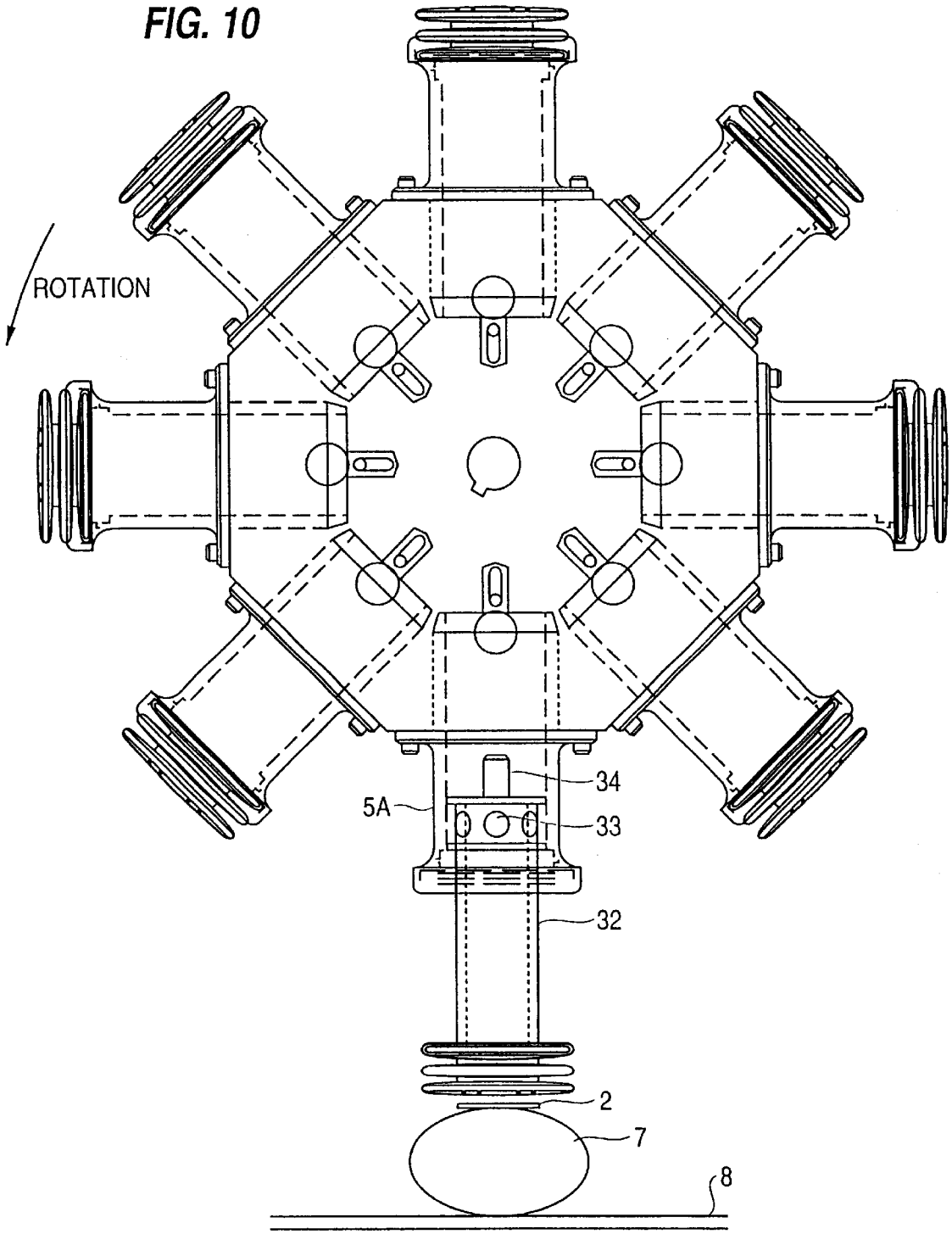
FIG. 10 shows a pickup head in a fully extended position, according to the third embodiment of the invention.

The pressure line (21) lines up with the pressure ports (44) on the body (47) (see also FIG. 8A), such that a pickup head (5A) at the label deposit position receives air pressure by way of the pressure line (21) and port (44). The air pressure is received at the firing piston (34) that is positioned adjacent to the port (44) when the pickup head (5A) is in its fully retracted position. The air pressure causes the firing piston (34) to fire. This in turn causes the piston (32) to move in a downwards direction, causing the applicator (33) to contact the object on the conveyor (positioned below the label applying apparatus) when the pickup head (5A) is in the fully extended position, as shown in FIG. 10. Hole (11) in FIG. 8B lines up with hole (13) in FIG. 8A. These holes are used to hold an axle or other similar type of device (not shown) for rotating body (47).

Figure 9:
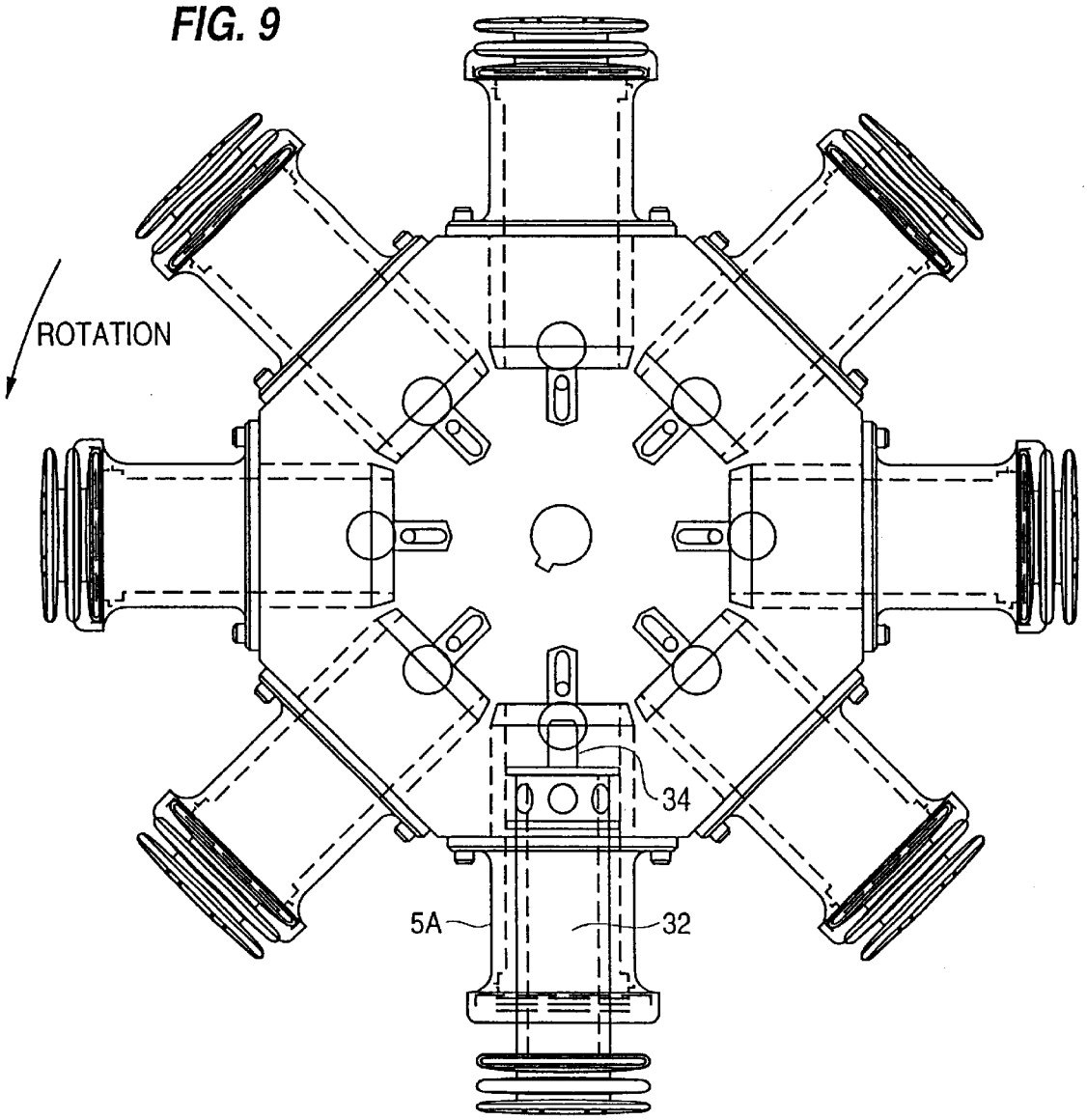
FIG. 9 shows a pickup head in a partially extended position, according to the third embodiment of the invention.

As shown in FIG. 9, when the pickup head (5A) has moved to a position where the sticky side of the label (2) faces the object (7) to be labelled, the vacuum is no longer supplied and pressure line (21) supplies a burst of air pressure. As discussed herein, the object is in position for labelling in this configuration at the six o'clock position. Those of ordinary skill will recognize that a system can be configured where the label is applied at any desired position, and not necessarily the 6 o'clock position.

The burst of air pressure at the labelling position causes the firing piston (34) in the small bore to begin to drive the pickup head (5A) outward toward the object to be labelled. The air pressure port (22) formed in applicator head (4) directs the air pressure toward the bottom of the small bore. A small bore is advantageous because it allows for fast response, an important consideration in labelling products on a line. The air burst generates sufficient momentum in the main piston in the pickup head to move the distal end of the applicator (37) outward toward the object (7). In this way, the label (2) is deposited on the object (7) when its sticky side faces the object. After the label (2) is deposited on object (7), the vacuum port is again activated by way of rotation of the applicator head (4) to retract the pickup head (5A). FIG. 9 illustrates the pickup head (5A) in a partially extended position, after just receiving the air pressure from the air supply (21). FIG. 10 illustrates the pickup head (5A) in the fully extended position, to effect labelling. The time between the partially extended position, as shown in FIG. 9, and the fully extended position, as shown in FIG. 10, is very short, for example, in the microsecond or millisecond range.

Figure 11:
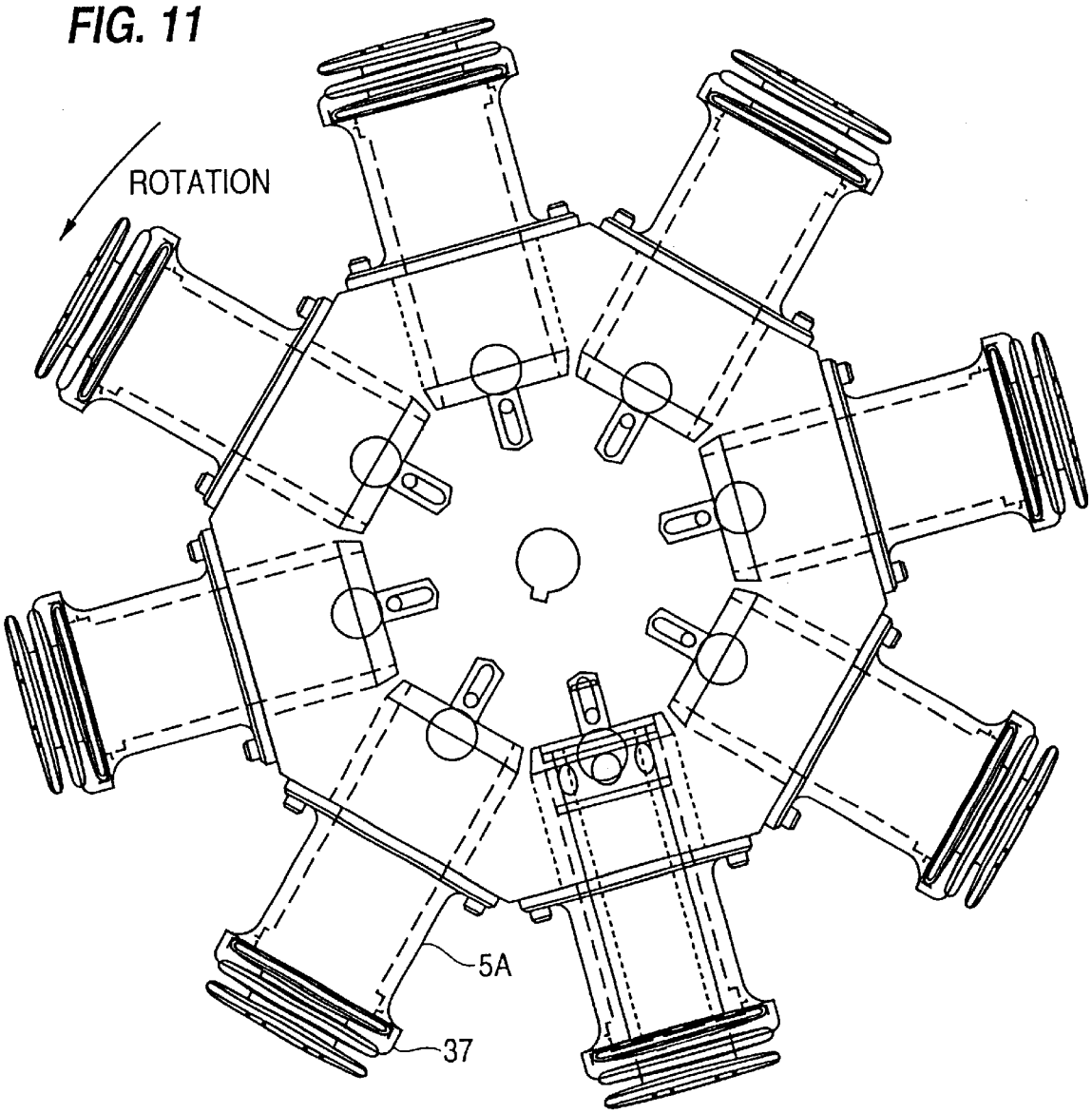
FIG. 11 shows a pickup head in a fully retracted position, soon after applying a label to an object, according to the third embodiment of the invention.

FIG. 11 illustrates the action taking place just after the label is deposited on the object. As FIG. 11 shows, after the pickup head (5A) deposits the label, it rotates out of position and the vacuum is again applied. At this time the vacuum acts to retract the main piston (32). The vacuum is constantly applied when the pickup head is out of the labelling position and is used later, for example at the 12 o'clock position, to pickup and hold another label on the applicator (37). As one of ordinary skill in the art will recognize, the vacuum ports and pressure supply can be switched or can be continuously supplied. For example, where the vacuum and pressure supplies are continuous, the pressure is always supplied as the pickup head passes the labelling position and the vacuum is always applied at the remaining positions. In this case, each pickup head advances outward and retracts at the same positions regardless of whether or not a label is being deposited. Alternatively, the system could be configured with switches operating synchronously with the labels to supply the air pressure only at times when a label is being applied. In this case, the pickup head would remain retracted as it passes the labelling position if no label is being applied, for example when no object is passing the labelling position.

The present invention allows the use of a low speed, high torque motor (which allows starting and stopping at a fast rate). The labels can be picked up and applied at a rate of 10/sec, printed at the rate of 10/sec, and dried at the rate of 10/sec. The very high acceleration rates required to transport a label to the printer and change the speed rapidly to pass it to an applicator head are achieved by using a stepper motor. The stepper motor operates in "open loop" configuration with feedback coming from sensors monitoring the position of product and label. This allows continuous monitoring of the presence and position of both the product and the label. The feedback is normally delivered by shaft encoders in a "closed loop" system as is known to those of ordinary skill. Ink-jet printers are used for high speed non-contact printing.

The labeler according to the invention provides a cost effective method of applying PLU codes to objects, including fruit and vegetables at packing plants. The printer prints and applies the correct label showing the product and the grade (the number of grades that can be printed is unlimited) on one label from stock.

The stepper motor delivers the label at high rates of speed (such as at 10/sec). The motors and sophisticated micro-stepping abilities of drivers (which give step number and direction of movement) are used to produce a high performance, low cost label feed system. The labeling machine may be controlled by software. The control by software uses a technique known as electronic gearing, and operates like meshed gears, where the movement of a slave axis is directly related to the movement of a master axis and may be used to control operation of the labeller herein. Preferably, a single axis controller is used. Using a single axis controller allows the expansion of the number of lanes controlled by adding a controller card per lane. This allows for any number of lanes to be controlled each with its own dedicated controller card.

An algorithm can be used to achieve synchronization in the apparatus. The motors run in a closed loop condition. As the label tape is advanced at such a high acceleration and deceleration rate, slippage can occur. To control the tape slippage, position sensing takes place at the tape using the optical sensor previously discussed herein rather than the conventional method of using an encoder on the motor shaft. This is accomplished by providing a hole punch between the labels and to read that slot position by way of an optical switch. Provision is made, not only to read that position, but to correct it when it is falling behind. There is some chance that the label position could also get advanced. A software routine is used to correct the position either by increasing or decreasing the advancing of the backer tape until the slot position is within an acceptable window. This window is controllable along with many other parameters in a set up mode. Thus, the labelling apparatus according to the invention can be used to label, for example, a large grapefruit or small tangerine oranges, or pop cans, simultaneously at the rate of 10/sec.

FIG. 12 illustrates a block diagram of a system in which a labeller according to the invention can be employed. Singulator (101) provides singulated items, such as fruit, to an optional rotator (109). The fruit or other item is then rotated as it passes through optical sensor (111). Optical sensor (111) may be a camera or other device which samples various parameters relating to grades of the item being graded. Processor (107) receives grading information from the optical sensor (111) which can be used by the labeller (113). For example, the processor (107) may store in a memory information concerning the grading of a particular item. It may then transmit that information to the labeller. Because labeller (113) prints the label as it is being applied, it is possible to print labels identifying different grades of the item. For example, when an item is graded into a certain category, its position is tracked through the system. When that particular item reaches the labeller, the processor (107) recognizes it and transmits to the labeller (113) instructions to put the appropriate label on the item. If the item is a premium grade, the labeller will print a premium grade label. If, on the other hand, the item is only a standard grade, the labeller will print a standard grade label. Those of ordinary skill will recognize that this technique can be used to identify any number of grades depending on the desired grading criteria. A feature of the invention is the ability of the labeller to print the label as the graded item passes by. In this way, different grades of items can be labelled simultaneously. A similar approach can be employed to label items based on weight, color, or any other desired parameter. Thus, the remaining elements of FIG. 12, such as weigh scale (115) can be used before the labelling takes place. FIG. 12 illustrates the use of drop stations (119) where items can be deposited after labelling.

To summarize, according to the invention, the label is turned on a tight curve and kept on the backer tape by a controlled air cushion, the ink is dried with the same air which keeps the label in place, the label is removed by peeling it off by air, the applying and printing of the label is done almost simultaneously, and the printing labeller has multiple applicator heads.

Figure 13A:
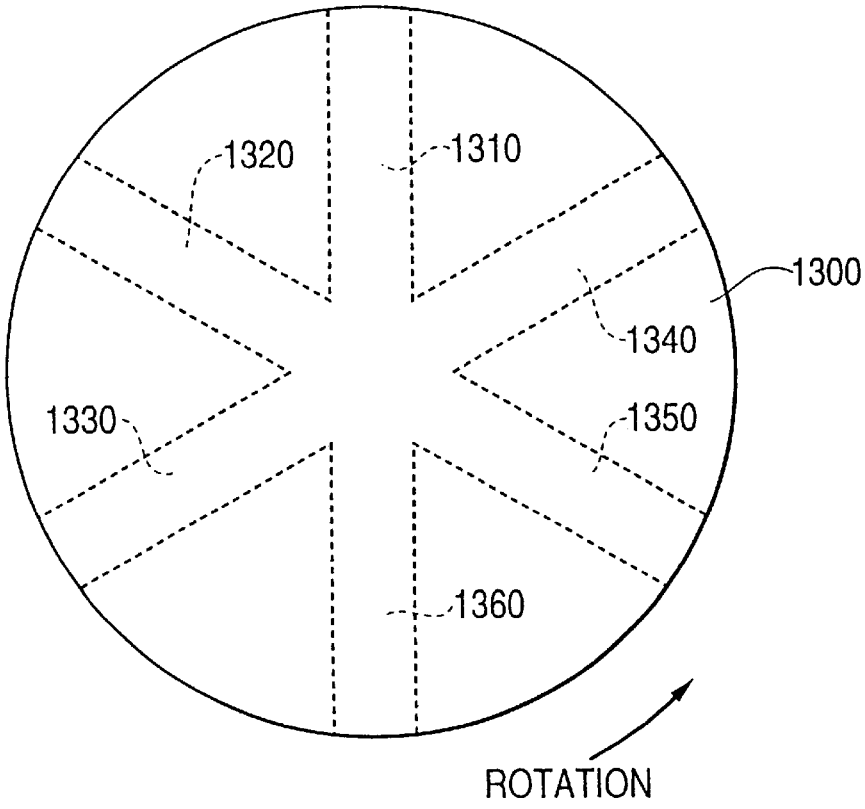
FIG. 13A shows a side view of a sponge applicator according to an alternative embodiment of the invention.
Figure 13B:
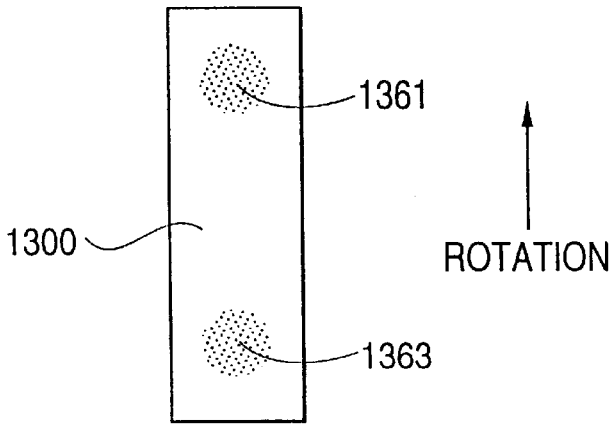
FIG. 13B shows a head-on view of the sponge applicator of FIG. 13A.

It should be noted that the applicator at the distal end of the any pickup head embodiment could also be a sponge applicator or any other material which would allow a vacuum applied to the pickup head to hold the label thereon. Alternatively, the entire applicator head can be a sponge-like device, where each pickup head corresponds to a perforation in the sponge-like device, with small holes at the top of each of the perforations. Referring now to FIGS. 13A and 13B, the sponge applicator 1300, which corresponds to a passive applicator, and which could be made out of urethane foam, so that it springs back quickly after it makes contact with an object, such as a fruit that has just been labeled. FIG. 13A shows the sponge applicator 1300 with six applying areas 1310, 1320, 1330, 1340, 1350, and 1360, with each area corresponding to an area where a label can be placed. As each labeled is placed onto one of the six applying areas of the sponger applicator 1300, such as at the 12 o'clock position, a vacuum is applied to maintain the label on the sponge applicator. Such a vacuum applying device could be the device shown as elements 20 and 20A in FIG. 8B, and the vacuum would be applied from the 7 o'clock position to the 5 o'clock position. Unlike the third embodiment, however, the sponge applicator embodiment does not use an air pressure source at the 6 o'clock position, since the sponge applicator 1300 is sized so that the labels at the 6 o'clock position impinge on objects that are moving on a conveyor positioned below the sponge applicator 1300. Once a label is provided onto an object at the 6 o'clock position, the vacuum is reapplied to set up for retrieving another label from the label applying position (e.g., the 12 o'clock position). FIG. 13B shows a side view of a portion of the sponge applicator, showing air holes positioned at two different locations 1361 and 1363, with those two locations corresponding to any adjacent two of the six locations 1310, 1320, 1330, 1340, 1350 and 1360 shown in FIG. 13A. These locations 1361 and 1363 are used to provide the vacuum to a maintain a label positioned on either or both of the locations 1361 and 1363.

While embodiments of the invention have been described herein, modification of the described embodiments may become apparent to those of ordinary skill in the art, following the teachings of the invention, without departing from the scope of the invention as set forth in the appended claims.

We claim:

1. A label applicator, comprising:

a label carrier containing a plurality of unprinted labels;

a print station including a printer, positioned to print a desired image on said unprinted labels to provide printed labels;

a pickup head for picking up the printed labels from said print station at a label transfer position, carrying said printed labels from said label transfer position to a label deposit position, and successively placing said printed labels on respective individual objects, said pickup head being extendable toward one of said individual objects at said label deposit position, said pickup head comprising a main piston attached to said applicator and a firing piston rigidly attached to one end of said main piston, said firing piston having a smaller diameter than said main piston;

a vacuum source being activated to hold printed labels on an applicator at a distal end of said pickup head, said pickup head being retractable by a vacuum provided by said vacuum source to a position at which labels are transferred to said applicator;

a first bore being of a size to accommodate said firing piston;

a second bore being of a size to accommodate said main piston, said second bore being of a larger diameter than said first bore; and a pressure source providing air pressure to said first bore to fire said firing piston, wherein said pickup head includes a vacuum port at a proximate end thereof, said vacuum port being in communication with an opening in said applicator so as to hold said printed labels on said pickup head, said vacuum port being in communication with said vacuum source, wherein said first bore includes a first opening on a sidewall thereof to receive said air pressure from said pressure source, and said second bore includes a second opening on a sidewall thereof to receive said vacuum from said vacuum source, wherein said first bore is positioned at an angle to direct said air pressure toward said firing piston, and wherein said firing piston is linked to said main piston so as to cause said main piston to move outwardly upon firing of said firing piston, thereby moving said main piston towards one of said individual objects.

2. A label applicator as recited in claim 1, said main piston being linked to said applicator such that after firing of said firing piston, momentum of said main piston drives said applicator towards one of said individual objects to deposit said label thereon.

3. A label applicator as recited in claim 2, said pickup head being mounted on an applicator head to rotate from said label transfer position to said label deposit position.

4. A label applicator as recited in claim 2, said vacuum source being routed to apply vacuum to said pickup head at said label transfer position, said pressure source being routed to supply air pressure to said firing piston at said label deposit position.

5. A label applicator as recited in claim 4, said vacuum source being routed to apply vacuum to said pickup head at a plurality of positions between said label transfer position and said label deposit position, wherein said vacuum is not applied to said pickup head at said label deposit position.

6. A label applicator as recited in claim 1, wherein said first bore has a diameter slightly greater than a diameter of said firing piston; and wherein said second bore has a diameter slightly greater than a diameter of said main piston.

7. A labeling apparatus, comprising:

a pickup head;

a vacuum source applying a vacuum to said pickup head;

a printer that prints information on a label supplied thereto while simultaneously said pickup head applies said vacuum to remove said label from a backing tape;

a moveable mounting, said pickup head being attached to said moveable mounting, said moveable mounting moving said pickup head from a label transfer position where said pickup head receives said label to a label deposit position where said pickup head deposits said label on an object; and a pressure source, wherein said pickup head includes a vacuum port through which said vacuum is applied, wherein said pickup head includes a main piston which is moveable in a direction to apply said label to said object, wherein said pickup head includes a firing piston and a firing bore, said firing piston being rigidly attached to said main piston, said firing piston being disposed within said firing bore, said main piston not being disposed within said firing bore, wherein said firing piston is linked to said main piston to drive said main piston in said direction to apply said label to said object, and wherein said firing bore is connected to receive air pressure from said pressure source only at said label deposit position.

8. A label applicator, comprising:

a label carrier containing a plurality of unprinted labels;

a print station including a printer, positioned to print a desired image on said unprinted labels to provide printed labels;

a pickup head for picking up the printed labels from said print station at a label transfer position, carrying said printed labels from said label transfer position to a label deposit position, and successively placing said printed labels on respective individual objects, said pickup head being extendable toward one of said individual objects at said label deposit position, said pickup head comprising a main piston attached to said applicator and a firing piston rigidly attached to one end of said main piston, said firing piston having a first diameter, said main piston having a second diameter greater than said first diameter;

a first bore in which said firing piston is positioned when said pickup head is in its fully retracted position; and a second bore in which said main piston is positioned at all positions between the fully retracted position and a fully extended position of said pickup head.

9. A label applicator as recited in claim 8, wherein said first bore has a third diameter that is slightly larger than said first diameter but is less than said second diameter, and wherein said second bore has a fourth diameter that is slightly larger than said second diameter.

* * * * *